United States Patent [19]

Buchmüller et al.

[11] 4,294,592

[45] Oct. 13, 1981

[54] APPARATUS FOR THE HYDRAULIC TRANSPORT OF PRECIPITATOR DUST

[75] Inventors: Horst Buchmüller, Hünxe; Bernhard Michelbrink, Wesel, both of Fed. Rep. of Germany

[73] Assignee: Deutsche Babcock Aktiengesellschaft, Oberhausen, Fed. Rep. of Germany

[21] Appl. No.: 161,653

[22] Filed: Jun. 20, 1980

[30] Foreign Application Priority Data

Jun. 29, 1979 [DE] Fed. Rep. of Germany ..... 2926330

[51] Int. Cl.[3] ..... B03C 3/00

[52] U.S. Cl. ..... 55/120; 406/95

[58] Field of Search ..... 55/117, 120, 101, 242; 406/93, 94, 146, 95; 210/525

[56] References Cited

U.S. PATENT DOCUMENTS

| | | | |
|---|---|---|---|
| 1,775,265 | 9/1930 | Allen | 406/95 |
| 2,625,676 | 1/1953 | Phyl et al. | 55/133 |
| 3,444,668 | 5/1969 | Masuda | 55/136 |
| 3,509,695 | 5/1970 | Egan et al. | 55/120 |
| 4,224,043 | 9/1980 | Dupre | 55/432 |

*Primary Examiner*—Bernard Nozick

*Attorney, Agent, or Firm*—Max Fogiel

[57] ABSTRACT

An arrangement for hydraulic transport of precipitator dust in a precipitator plant, which is provided with several hoppers. These are consecutively arranged in flow direction of the gas to be cleaned passing through precipitator cells. The hoppers are located underneath a discharge device, and are provided with a sluice chamber having an inlet for rinse water and an outlet for a mixture of rinse water and precipitator dust. The exit of the sluice chamber of the rear hopper, in gas flow direction, is connected with the inlet of the sluice chamber of the preceding hopper by one sluiceway each. The sluice chamber of the last hopper, only, is supplied with fresh rinse water. The outlet gutter following the exit of the sluice chamber of the first hopper, may be closed by a weight-loaded flap.

5 Claims, 1 Drawing Figure

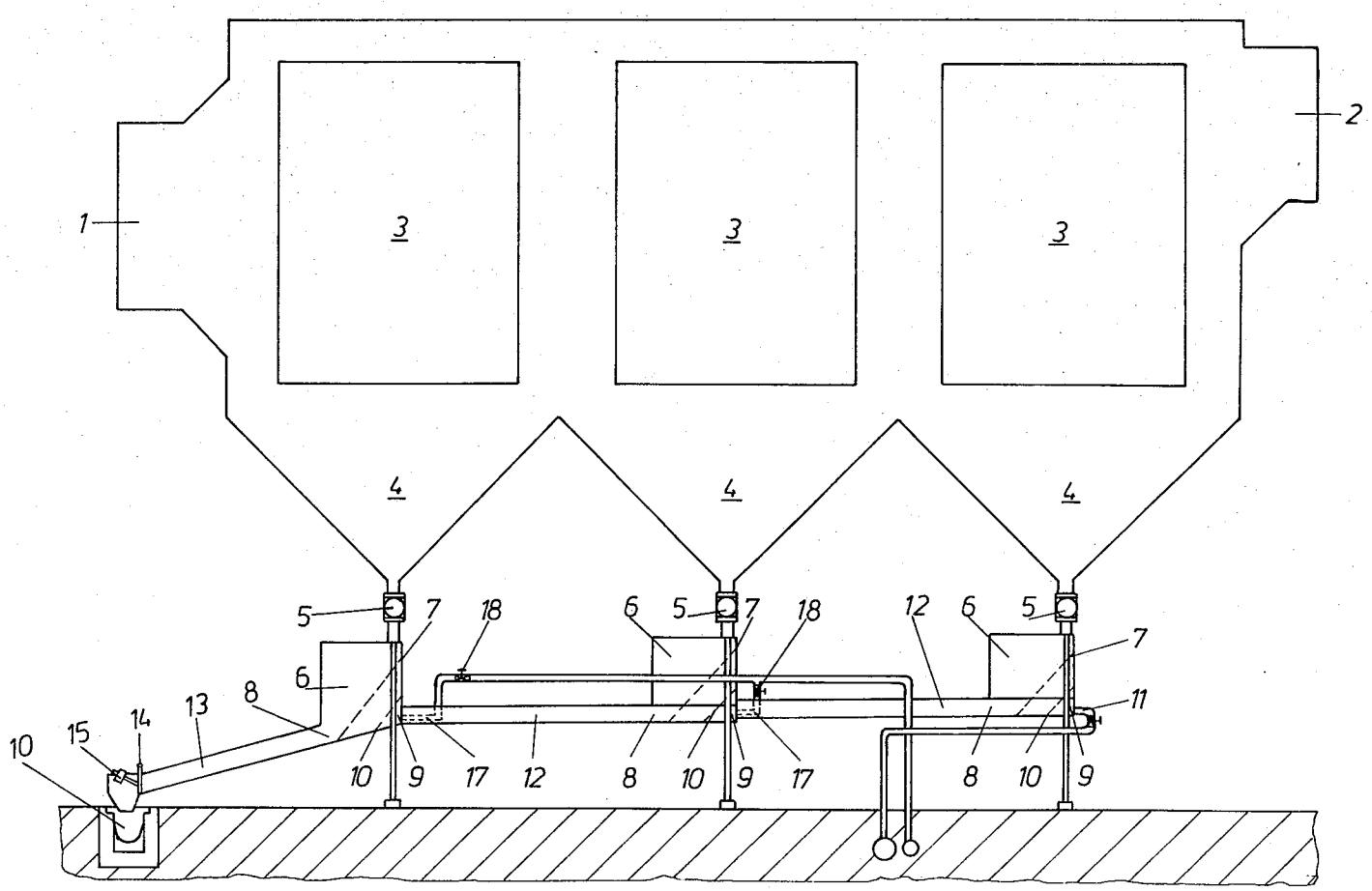
1
2
3
3
3
4
4
4
5
5
5
6
6
6
7
7
7
8
8
8
9
9
9
10
10
10
11
12
12
13
14
15
17
17
18
18

APPARATUS FOR THE HYDRAULIC TRANSPORT OF PRECIPITATOR DUST

BACKGROUND OF THE INVENTION

The present invention relates to apparatus for the hydraulic transport of precipitator dust from a precipitator plant which is provided with several hoppers consecutively arranged in flow direction of the gas to be cleaned. Underneath the discharge organ, there is provided a sluice chamber having an inlet for the rinse water and an outlet for the mixture from rinse water and precipitator dust.

Each hopper of such a precipitator plant is associated with one precipitator cell and is provided with an own rinse water connection. The bulk of the dust is obtained in the precipitator cell which is the first to receive the gas to be cleaned; this dust must be discharged through the respective hopper. As the first precipitator cell may fail and its function must then be performed by the second precipitator cell, the rinse water connection of each hopper must be designed for a rinse water flow rate which suffices for eliminating the full dust quantity obtained. This results in large pipework cross-sections for the rinse water connection. Furthermore, the water consumption is increased by the separate rinse water feed.

SUMMARY OF THE INVENTION

The present invention pursues the object of improving the above described apparatus for the hydraulic transport of precipitator dust with a view to simplifying the physical design and lowering the rinse water consumption.

Another object of the present invention is to provide apparatus of the foregoing character which is substantially simple in construction and may be economically fabricated.

A further object of the present invention is to provide an arrangement, as described, which may be readily maintained in service and which has a substantially long operating life.

According to the present invention, the objects are achieved by establishing a pipe connection between the exit of the sluice chamber which is the rearmost in flow direction of the gas, and the inlet of the sluice chamber of the preceding hopper. Fresh rinse water is supplied only to the sluice chamber of the rear hopper.

Under this arrangement the rinse water flow rate that is added is restricted to what is required for transporting the maximum precipitator dust obtained. This rinse water flow rate is also available when the first precipitator cell is failing, and the precipitator dust must be discharged from the second precipitator cell. The present invention is inspired by the concept that the dust load of the rinse water in the sluice chambers of the rear hoppers is only so large that, in spite of this load, the rinse water is still able to discharge the bulk of the precipitator dust. The water consumption for transporting the precipitator dust from the precipitator plant may thus be reduced without adversely affecting the functioning of the hydraulic hauling equipment.

In an advantageous embodiment of the present invention, the pipework connecting with the exit of the sluice chamber of the first hopper may be closed by a weight-loaded flap. Weight adjustment may enable the flap to open only when a certain rinse water level has been established in the piping. Sealing against the outside atmosphere is possible in this way.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

A side view of a precipitator plant with apparatus for the hydraulic transport of precipitator dust, in accordance with the present invention.

DESCRIPTION OF THE PREFERRED EMBODIMENTS

The precipitator plant represented schematically is designed as an electrostatic precipitator and is provided with a gas inlet 1 as well as a gas outlet 2. In the embodiment shown, the inside of the precipitator plant comprises three precipitator cells 3 through which the gas to be cleaned flows successively. Below each precipitator cell 3 there is one hopper 4 which is closed by a star wheel 5. The dust separated in the precipitator cell 3 is collected in the hopper 4 and is continuously discharged through the star wheel 5.

In place of the star wheel 5, it is also possible to use another discharge device which seals the outside atmosphere from the inside of the precipitator plant.

The precipitator dust obtained in a dry condition is hydraulically removed. To this end it enters into contact with rinse water in a sluice chamber 6. This sluice chamber 6 follows the star wheel 5. Below the discharge opening of the star wheel 5, an oblique chute 7 is arranged inside of the sluice chamber 6; the precipitator dust slides down on this chute, and is admitted from there to the exit 8 of the sluice chamber 6.

Above its bottom, the sluice chamber 6 is provided with an inlet 9 for rinse water. An oblique splash plate 10 is arranged underneath the chute 7 in the flow route of the rinse water. The rinse water impinging onto this splash plate 10 flows downward on it in the form of a film, enters onto the bottom of the sluice chamber 6, and causes the precipitator dust sliding down from the chute 7 to be taken out of the sluice chamber 6 through the exit 8.

The sluice chamber 6 of the last hopper 4, in flow direction of the gas to be cleaned, is provided with an inlet port 11 through which fresh rinse water is supplied into this sluice chamber 6. The exit 8 of this sluice chamber is followed by a sluiceway 12 having the form of a covered gutter. The sluiceway 12 is slightly inclined. It terminates in the inlet 9 of the preceding sluice chamber 6. The rinse water arriving from the last sluice chamber 6 and partly loaded with dust serves therefore as a rinse medium in the next sluice chamber. In the same manner, the exit 8 of the last but one sluice chamber 6 is connected with the inlet 9 of the first sluice chamber 6.

The exit 8 of the first sluice chamber 6 passes over into an outlet gutter 13 which is closed by a flap 14 at its front end. The flap 14 is loaded by a weight 15 which keeps this flap closed until a certain water level has been established in the outlet gutter 13. The outlet gutter 13 discharges into a sluiceway 16 from which the dust is supplied, by means of the rinse water, to a settling basin (not shown).

Except for the rear sluice chamber 6, the inlet 9 of each sluice chamber 6 is provided with a port 17. Additional rinse water can be supplied into the respective sluice chamber 6 through the port 17. Water from the settling basin may be used as additional rinse water. The supply of the rinse water to the ports 17 may be interrupted by means of a shutoff valve 18.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. Apparatus for precipitating dust and the hydraulic transport of precipitator dust from a precipitator plant, comprising precipitator cells; a plurality of hoppers consecutively arranged in flow direction of gas to be cleaned by said precipitator cells; discharge means connected to said hoppers; a sluice chamber for each hopper and connected to said discharge means underneath said hoppers, said sluice chamber having an inlet for rinse water and an outlet for a mixture of rinse water and precipitator dust; the outlet of the sluice chamber of the rear hopper in gas flow direction being connected with the inlet of the sluice chamber of the preceding hopper by one sluiceway each, only the sluice chamber of the last hopper being supplied with fresh rinse water; each chamber having only a single source of rinse water, the sluice chamber of the last hopper having an outlet connected to an inlet of its immediately preceding sluice chamber so that said latter chamber is rinsed with water already containing filtered dust; said latter chamber having an outlet connected to the input of its own immediately preceding chamber so that the rinse water flows thereby in sequence through all sluice chambers located below the individual hoppers, the rinse water becoming increasingly laden with dust in its flow direction, the flow direction of the rinse water being opposite to the flow direction of the gas to be cleaned.

2. Apparatus as defined in claim 1, including an additional rinse water line connected with each sluice chamber except for the near sluice chamber by way of one shutoff valve each.

3. Apparatus as defined in claim 1, including an outlet gutter following said outlet of the sluice chamber of the first hopper; a weight-loaded flap for closing said outlet gutter; an additional rinse water line connected with each sluice chamber by way of one shutoff valve each; said discharge means comprising star wheel means; an oblique chute being arranged inside the sluice chamber below said discharge means, precipitator dust sliding down on said chute and being admitted from said chute to the outlet of the sluice chamber; said sluice chamber having an oblique splash plate underneath said chute in the flow direction of the rinse water, rinse water impinging onto said splash plate and flowing downward on said splash plate in form of a film and entering onto the bottom of the sluice chamber, the rinse water removing the precipitator dust sliding down from said chute out of the sluice chamber through the chamber outlet; said flap being held in closed position until a predetermined water level is attained in the outlet gutter.

4. Apparatus as defined in claim 1, including an outlet gutter following said outlet of the sluice chamber of the first hopper; and a weight-loaded flap for closing said outlet gutter.

5. Apparatus as defined in claim 4, including an additional rinse water line connected with each sluice chamber except for the rear sluice chamber by way of one shutoff valve each.

* * * * *